US007530813B1

(12) United States Patent
Tsai et al.

(10) Patent No.: US 7,530,813 B1
(45) Date of Patent: May 12, 2009

(54) COAXIAL CONNECTOR

(75) Inventors: Chih Hong Tsai, Guangdong (CN); Qing Hai Ou, Guangdong (CN)

(73) Assignee: Suyin Electronics (Dongguan) Co., Ltd., Guangdong (CN)

( * ) Notice: Subject to any disclaimer, the term of this patent is extended or adjusted under 35 U.S.C. 154(b) by 0 days.

(21) Appl. No.: 12/193,670

(22) Filed: Aug. 18, 2008

(51) Int. Cl.
*H01R 12/00* (2006.01)

(52) U.S. Cl. ..... 439/63; 439/607

(58) Field of Classification Search ..... 439/63, 439/578, 581, 607
See application file for complete search history.

(56) References Cited

U.S. PATENT DOCUMENTS 5,192,230 A * 3/1993 Gabany et al. ..... 439/620.1
5,217,391 A * 6/1993 Fisher, Jr. ..... 439/578
6,099,334 A * 8/2000 Togashi ..... 439/188
6,296,492 B1 * 10/2001 Fujimoto et al. ..... 439/63
6,520,785 B2 * 2/2003 Hida ..... 439/188

* cited by examiner

*Primary Examiner*—Neil Abrams
*Assistant Examiner*—Phuong Nguyen
(74) *Attorney, Agent, or Firm*—Banger Shia

(57) ABSTRACT

The present invention pertains to a coaxial connector including an insulating base disposing a central terminal passing through a hole thereof to facilitate signal transmission, a first and a second terminals including secure plates to be disposed on a deep slot of the insulating base, a waterproof ring, and a metal shell. Wherein, the secure plates have fixing flanks to strengthen the firmness between the terminals and the insulating base. Wave-shaped contacts with high resilience further protrude from the fixing flanks to prop against or separate from the switch button of the mobile communication device for getting through or disconnecting the communication. Through the highly elastic contacts, the terminals still maintain to firmly contacting with the switch button or rapidly bouncing back even when being subjected to a long-term compression and ensure the stability of the mutual signal transmission among the mobile communication devices.

11 Claims, 4 Drawing Sheets

COAXIAL CONNECTOR

BACKGROUND OF THE INVENTION

1. Field of the Invention

The present invention relates to a coaxial connector, in particular to a coaxial connector applying for mobile communication devices.

2. Description of the Related Art

There is a wide application of apparatus used to a mobile communication device in the real life, for instance of an intercom which is one of the main communication devices for functions of public securing or traffic controlling. Conventionally, the intercom mainly has a body and an antenna system to receive external signals. For receiving signals, the antenna is typically bound to an exteriorly assembled coaxial connector of the body providing with a signal converting circuit. In addition, the coaxial connector has to dispose terminals therein which further engage with a switch button in the body hence achieving a mutual communication. Therefore, the attachment of the terminals with the coaxial connector is a critical factor implementing to efficiently receive external signals and achieve mutual communications.

However, the infirm installation of the conventional coaxial connector commonly exists while the terminals are not well incompliance with its insulating base, which negatively incurs the deviation and departure of terminals from the connector or causes other inferiors. Moreover, since the intercom is highly used, the contact frequency between the switch button and the coaxial connector is raised. Over a long-term compression, the elasticity of the terminals becomes weak, and the contact of the terminals and the switch button is relatively affected, which may result of an improper contact and clogged communication and obstruct the implement of the public security. That is, if the improper contact and clogged communication occur, the suspicious staffs may have the opportunity of escaping while on duty and make serious consequences. Further, the conventional connector requires complex manufactures and installations, and the replacement with a new one usually needs complicated procedures and even causes the unwillingness of using the connector for people. Accordingly, due to the complicated and inefficient assembling procedure of the conventional coaxial connector, the present invention is hence provided.

SUMMARY OF THE INVENTION

One object of the present invention is to provide a coaxial connector for enhancing stability of the signal transmission and prolonging the life time of products.

Another object of the present invention is to provide a coaxial connector that can be readily assembled, thereby promoting the installing efficiency and declining the percentage of inferior products.

The coaxial connector in accordance with the present invention mainly provides with an insulating base, a central terminal, a first terminal, a second terminal, a waterproof ring, and a metal shell. Wherein, the insulating base includes a lower base and an upper base defining a central stand providing a hole to be penetrated by the central terminal. The central stand has its back to be constructed by a lateral wall, from both ends of which two side walls respectively extended and equidistantly spaced with respect to sides of the central stand. Wherein, one of the two side walls has a deep slot, comprised of a first slot and a second slot, laterally disposed through the lateral wall for receiving the first and second terminals. The first and second terminals have respective secure plates that are correspondingly firmly connected with walls of the first and second slots, and the secure plates further contain a plurality of fixing flanks with wave-shaped contacts attaching thereon. The wave-shaped contacts especially have high resilience and a capability of readily bouncing back so as to guarantee a firm contact of the switch button and the coaxial connector while being subjected to a long-term compression and enhance the quality of the mutual communications.

Further by the integration of the lower base with the upper base, the above terminals are firmly positioned in the insulating base, so as to avoid deviation of the terminals and prevent bad influence on the connector arising from the departure. Moreover, signals can be received and transmitted by the central terminal of the coaxial connector contacting a separate antenna of the mobile communication device; thereby, communication can be transported or disconnected by the contact or interruption between the switch button and the wave-shaped contacts protruded from the first and second terminals. Owing to the characteristic of the wave-shaped contacts, they are able to maintain their resilience along with a firm connection with the switch button for ensuring the stability of the mutual signal transmissions among the mobile communication devices.

Therefore, the present invention applies the correlation of above elements to firmly position the terminals and the insulating base and accompanies the wave-shaped contacts with high elasticity that densely touch and cooperate with the switch button, thereby achieving a more stable signal transmission of communication, a quick assembling of the coaxial connector, and prolonging products life time The advantages of the present invention over the known prior arts will become more apparent to those of ordinary skilled in the art by reading the following descriptions with relating drawings.

DETAILED DESCRIPTION OF THE PREFERRED EMBODIMENTS

Figure 1:
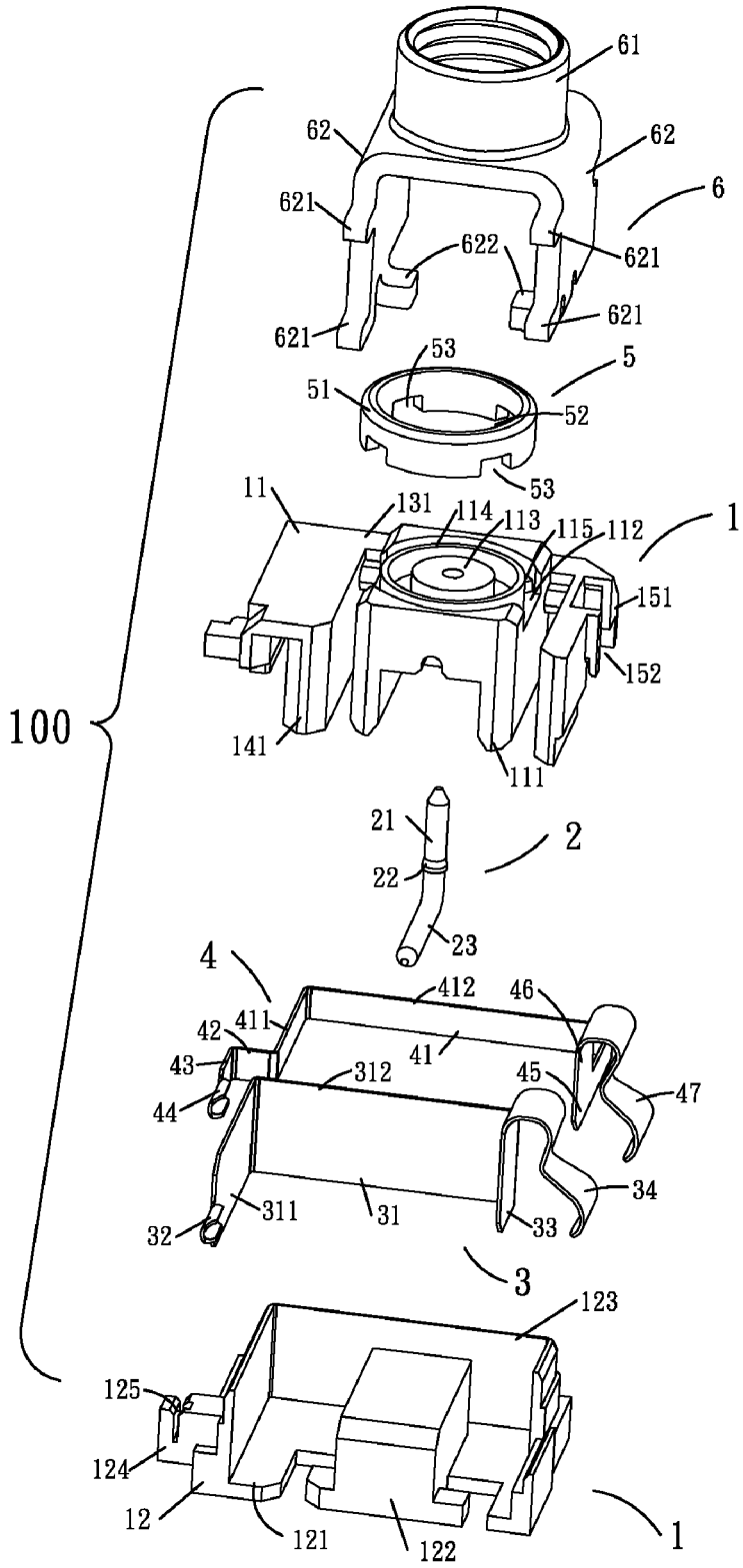
FIG. 1 is a perspective view showing the present invention.

Before describing in greater detail, it should note that the like elements are denoted by the similar reference numerals throughout the disclosure.

Referring to FIG. 1, the coaxial connector 100 of the present invention mainly provides with an insulating base 1, a central terminal 2 disposed in the insulating base 1, a first terminal 3, a second terminal 4, a waterproof ring 5, and a metal shell 6.

Figure 2:
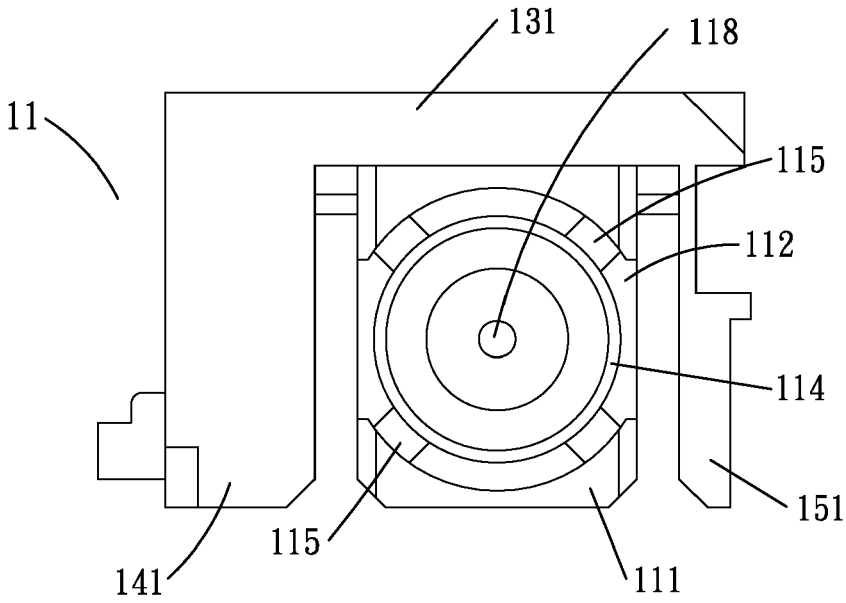
FIG. 2 is a plan view showing a top view of the upper base of the present invention.
Figure 3:
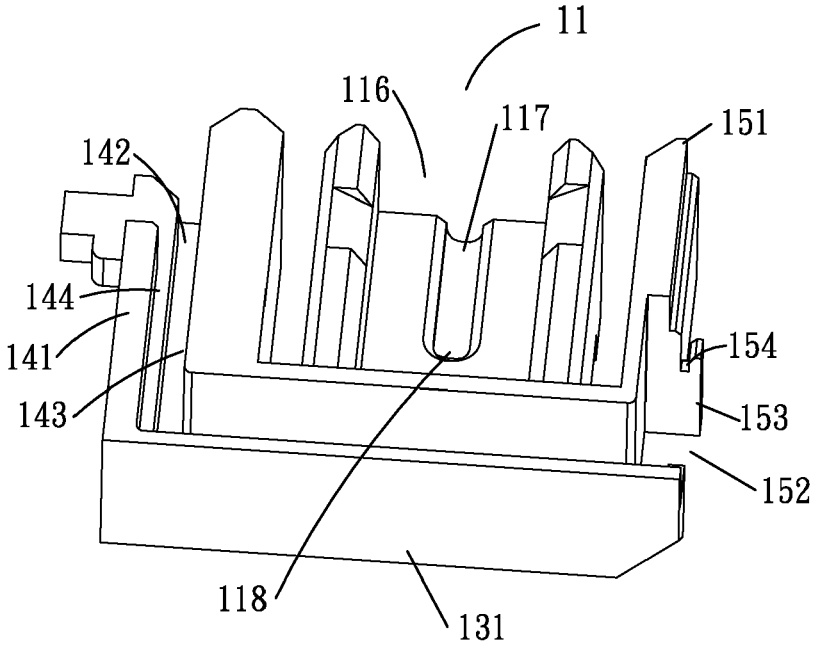
FIG. 3 is a perspective view showing a bottom view of the upper base of the present invention.

Referring to FIGS. 1, 2, and 3, the insulating base 1 includes a lower base 12 and an upper base 11. Wherein, the upper base 11 has a central stand 111 defining an unclosed round recess 112 on its top surface, where a round protrusion 114, including a central cylinder 113 disposed among it, is protruded. A plurality of gripping blocks 115 are equidistantly mounted around the outer periphery of the round protrusion 114 and the inner wall of the unclosed round recess 112. An indentation 116 with a U-shaped notch 117 provided thereon is defined on the bottom surface of the central stand 111; the U-shaped notch 117 further installs a hole 118 in the front thereof to go through the central stand 111. In particular, the central stand 111 has its back to be constructed by a lateral wall 131, from both ends of which a broad side wall 141 and a narrow side wall 151 oppositely extended and equidistantly spaced with respect to both sides of the central stand 111 by an interval. Wherein, the broad side wall 141 has a deep slot 142 defined on the bottom surface thereof that transversely penetrates through the lateral wall 131 and consists of a first and a second slots 143, 144. Relatively, the narrow side wall 151 includes a fixing notch 152 communicating with the deep slot 142 so as to form a holder 153 that is located on a wall of the fixing notch 152 distant from the lateral wall 131 and provided with a receiving notch 154 thereon.

Still, the lower base 12 has a bottom stand 121, a central support 122 protruding from the stand 121 to be fitly wedged into the indentation 116, and a backboard 123 formed around the bottom stand 121. The backboard 123 is designed in compliance with the deep slot 142 of the upper base 11 and formed in a stairway structure at its side periphery. A support stand 124, which has a wedging notch 125 disposed thereon for fixing the terminals, is defined at the outer side of the backboard 123 to engage with the broad wall 141 of the upper base 11.

The central terminal 2 has a central secure member 21, a strengthening band 22 on the central secure member 21 for allowing the central terminal 2 to be firmly fixed to the upper base 11, and a central insertion portion 23 integrally defined at the bottom of the central secure member 21 for outwardly connecting a circuit board.

The first and second terminals 3, 4 have their respective secure plates 31, 41; wherein, the first secure plate 31 and the second secure plate 41 herein are flatwisely structured by a lying '7' shape. The first secure plate 31 has a first longitudinal plate 311 directly extending outward and terminating at a first insertion 32, a first transverse plate 312 whose rear portion is bended, and a short fixing flank 33 extending from the inflection of the transverse plate 312 so that the fixing flank 33 is parallel to the first longitudinal plate 311 and is wedged into the fixing notch 152. Particularly, the short fixing flank 33 outwards forms a first wave-shaped 34 contact that performs in an incessant undulation with an equal width. Likewise, at one end of a second longitudinal plate 411 of the second terminal 4 curvedly defines a transition plate 42 parallel to a second transverse plate 412; thence, a fixing plate 43 parallel to the second longitudinal plate 411 is defined at the inflection of the transition plate 42, and a second insertion 44 is located at the end of the fixing plate 43. Furthermore, the second secure plate 41 has the second transverse plate 412 bending along its rear portion to define a long fixing flank 45 which is parallel to the second longitudinal plate 411 and protrudes a vertical plate 46 from the front edge of the flank 45; the vertical plate 46 is further bent and then projects a second wave-shaped contact 47 therefrom. The wave-shaped contacts 34, 47 both provide with the characteristic of high resilience for efficiently bearing against the outer force by pressing the switch button and rapidly bouncing themselves back while being not subjected to the outward force, so as to promote the utility of the terminals.

The waterproof ring 5 is mainly beneficial to prevent the coaxial connector from being saturated with water. The waterproof ring 5 wedges into the central stand 111 of the upper base 11 and further has a column 51 with an opening 52; a plurality of recesses 53 are equidistantly segmented along the bottom surface of the column 51 to fit with the gripping blocks 115, whereby the waterproof ring 5 can be firmly assembled to the upper base 11.

The metal shell 6 has a cannular sleeve 61 with a plurality of side arms 62 defined along the circumference of the cannular sleeve 62, at least two fixed legs 621 protruded from the front edge of the side arms 62, and a plurality of holder blocks 622 laterally defined on the bottom edge of the side arms 62.

Figure 4:
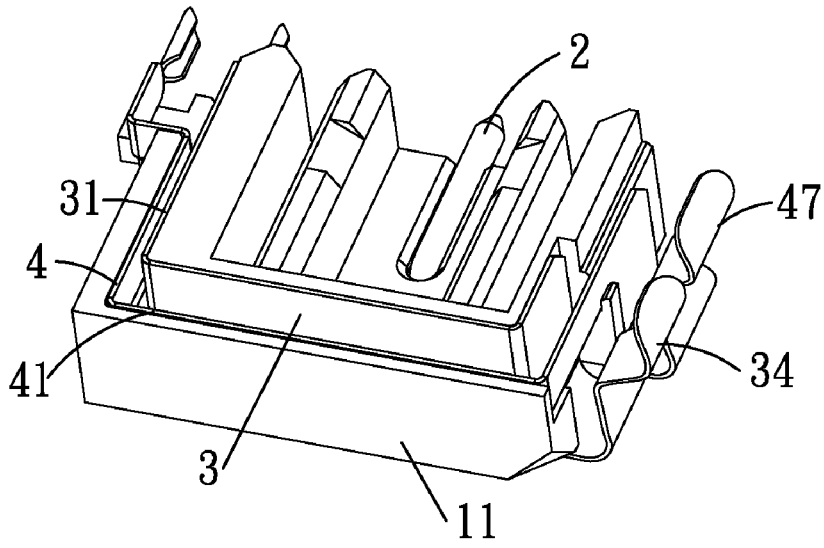
FIG. 4 is a perspective view showing the combination of the terminals and the upper base of the present invention.
Figure 5:
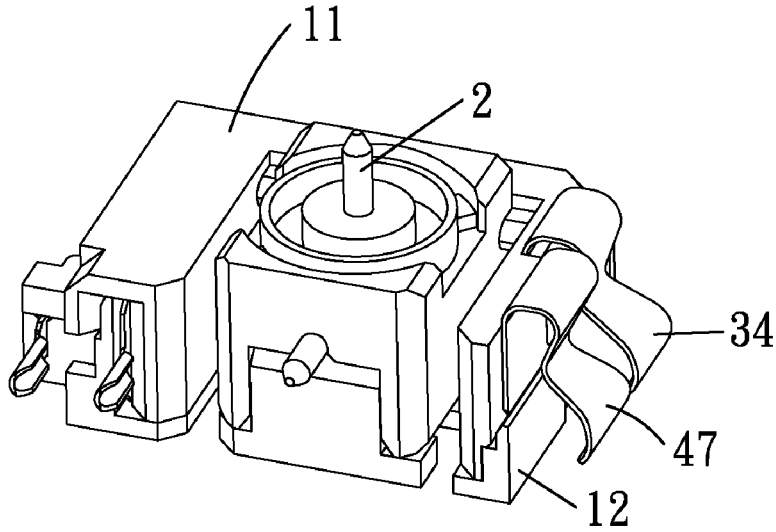
FIG. 5 is a perspective view showing the configuration of FIG. 4 assembling to the lower base.

Further, the central, the first and the second terminals 2, 3, 4 are respectively punched and made of metal planking. While in installation, those punched terminals are discretely assembled to the upper base 11 as illustrated in FIG. 4. The central secure member 21 of the central terminal 2 thence penetrates through the hole 118 of the upper base 11 and renders the central insertion portion 23 to snap into the U-shaped notch 117 and partially expose out of the upper base 11. With regard to FIGS. 1 through 4, the first terminal 3 has to be assembled before the second terminal 4. Namely the first secure plate 31 is initially engaged to the inner wall of the first slot 143, and the short fixing flank 33 is then positioned within the fixing notch 152 for exposing the first wave-shaped contact 34. Thereafter, the second secure plate 41 firmly contacts with the wall of the second slot 144 so as to keep the interstice between the first and second secure plates 41, 31. Moreover, the long fixing flank 45 longer than the short fixing flank 33 tends to be embedded into the receiving notch 154 of the holder 153, whereby the second terminal 4 can be firmly disposed on the upper base 11. The second wave-shaped contact 47 also exposes from the long fixing flank 45 and juxtaposes with respect to the first wave-shaped contact 34 (shown in FIG. 5).

Thereafter, the lower base 12 and the upper base 11 can be a congregate assembly by following the succeeding steps. Referring to FIGS. 1 to 5, the central terminal 2 is firmly suited in the insulating base 1 by fitly placing the central support 122 into the indentation 116. The backboard 123 of the lower base 12 structuring a stairway contour at the side periphery thereof is inserted into the deep slot 142 to directly prop and position the first and second terminals 3, 4 and absolutely separate the first terminal 3 from the second terminal 4, hereby the terminals are firmly fixed to the upper base 11. In addition, the fixing plate 43 of the second terminal 4 is also wedged into the wedging notch 125 of the lower base 12, hence accomplishing the installation of the upper base 11 with the lower base 12 and rendering the central, first, and second terminals 2, 3, 4 not to be readily deviate from the insulating base 1 for securing a stable signals transmission, which can be clearly shown in FIG. 5. After assembling the upper and lower bases 11, 12, the assembly is associated by ultrasonic wave.

Figure 6:
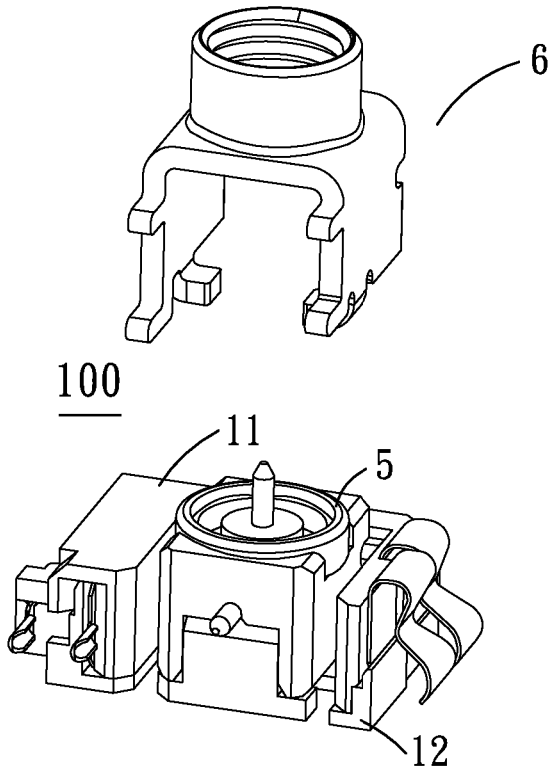
FIG. 6 is a perspective view showing both the waterproof ring and the metal shell installing on the combination of FIG. 5.
Figure 7:
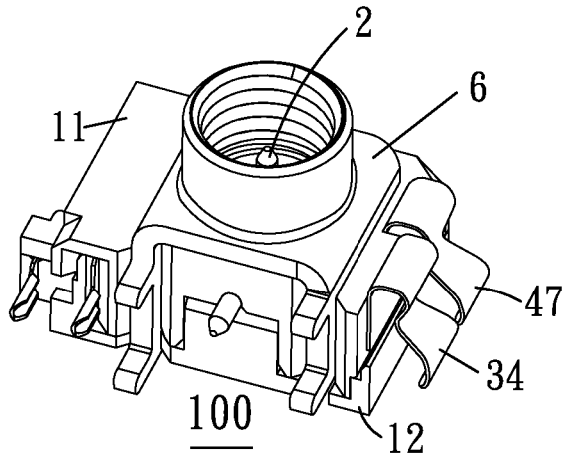
FIG. 7 is a perspective view showing the integral structure of the present invention.

Further referring to FIGS. 1 and 6, the waterproof ring 5 is mounted on the central stand 111 of the upper base 11. It should be noted that the holder blocks 622 are erect structures for buckling themselves on the central stand 111 before embedding the side arms 62 of the metal shell 6 succeedingly among the interval between the central stand 111 and the two side walls 141,151. The metal shell 6 further facilitates connecting the antenna and fixing the waterproof ring 5. Therefore, the assembled and complete coaxial connector 100 is accomplished as shown in FIG. 7.

To sum up, the present invention takes advantages of a central terminal engaging with an antenna of a communication device to transmit signals. Furthermore, a first terminal and a second terminal have stable secure plates and fixing flanks to enable each terminal to be firmly and separately fixed in an insulating base while assembling the upper and lower bases together, which efficiently eliminates the deviation of terminals and achieves a more stable signal transmission. Further, the wave-shaped contacts protruded from the terminals have the characteristic of high resilience contributing readily bouncing back, thereby ensuring the dense contact of terminals with a switch button under a long-term compression and promoting the mutual communicating stability among mobile communication devices.

While we have shown and described the embodiment in accordance with the present invention, it should be clear to those skilled in the art that further embodiments may be made without departing from the scope of the present invention.

I claim:

1. A coaxial connector comprising an insulating base, a central terminal, a first terminal, a second terminal, a waterproof ring, and a metal shell;

wherein, said insulating base including a lower base and an upper base, and said upper base defining a central stand thereon; said central stand providing with a lateral wall, from both ends of which a broad side wall, as well as a narrow side wall, respectively extend and spaced with respect to both sides of said central stand by an equidistant interval;

wherein, one of said above side walls including a deep slot at a bottom surface thereof transversely penetrating through said lateral wall, and the other one thereof oppositely having a fixing notch disposed thereon for being in communication with said deep slot; said deep slot including a first slot and a second slot firmly affixed to first and second secure plates defined on said first and second terminals; said first and second secure plates respectively containing fixing flanks, on which wave-shaped contacts formed in an incessant undulation being disposed.

2. The coaxial connector as claimed in claim 1, wherein said fixing flank of said first terminal is directly bent to extensively expose said wave-shaped contact thereof by an equal width; said fixing flank has a vertical plate protruded from the front edge thereof and outwardly bent so that said wave-shaped contact of said second terminal contact can project therefrom.

3. The coaxial connector as claimed in claim 1, wherein on the top surface of said central stand of said upper base defines an unclosed round recess protruded by a round protrusion with a central cylinder; a plurality of gripping blocks are equidistantly mounted between the outer periphery of said round protrusion and the inner wall of said unclosed round recess; an indentation with a U-shaped notch is defined on the bottom surface of said central stand; said U-shaped notch further installs a hole in the front thereof to go through said central stand.

4. The coaxial connector as claimed in claim 1, wherein a wall of said fixing notch distant from said lateral wall forms a holder with a receiving notch thereon.

5. The coaxial connector as claimed in claim 1, wherein said lower base and said upper base are designed correspondingly; said lower base has a bottom stand, a central support protruding from said bottom stand, and a backboard located around the side periphery of said bottom stand and structured by a stairway design for being in compliance with said deep slot of said upper base.

6. The coaxial connector as claimed in claim 1, wherein said central terminal has a central secure member, a strengthening band arranged on said central secure member for securing with said upper base, and a central insertion portion extending from the bottom of said central secure member for connecting a circuit board.

7. The coaxial connector as claimed in claim 1, wherein said waterproof ring applied for being wedged into said central stand has a column with an opening and a plurality of recesses equidistantly segmented along the bottom surface of said column.

8. The coaxial connector as claimed in claim 1, wherein said metal shell has a cannular sleeve, side arms defined along the edge of said cannular sleeve, at least two fixed legs protruded from the front edge of said side arms, and holder blocks laterally defined on the bottom edge of said side arms.

9. The coaxial connector as claimed in claim 1, wherein said first and second secure plates of said first and second terminals lie flat to structure in a lying '7' shape; said first and second secure plates further have their respective longitudinal plates and transverse plates; said fixing flanks extending from inflections of said transverse plates at their rear edges are correspondingly parallel to said longitudinal plates.

10. The coaxial connector as claimed in claim 9, wherein said fixing flank of said first secure plate is shorter than said fixing flank of said second secure plate.

11. The coaxial connector as claimed in claim 9, wherein said longitudinal plate of said first secure plate outward extends and terminates at a first insertion; said longitudinal plate of said second secure plate inflectionally defines a transition plate parallel to said transverse plate thereof; a fixing plate is prolongedly formed at an inflection of said transition plate for being parallel to said longitudinal plate, and a second insertion is disposed at the end of said fixing plate.

* * * * *